US007182056B1

(12) United States Patent
Czysz

(10) Patent No.: US 7,182,056 B1
(45) Date of Patent: Feb. 27, 2007

(54) INVERTED POPPET VALVE FOR INTERNAL COMBUSTION ENGINE

(75) Inventor: Michael Czysz, Portland, OR (US)

(73) Assignee: MotoCzysz LLC, Portland, OR (US)

( * ) Notice: Subject to any disclaimer, the term of this patent is extended or adjusted under 35 U.S.C. 154(b) by 0 days.

(21) Appl. No.: 11/213,097

(22) Filed: Aug. 26, 2005

(51) Int. Cl.
*F01L 3/20* (2006.01)

(52) U.S. Cl. ..... 123/188.3; 29/888.4; 251/333

(58) Field of Classification Search ..... 123/193.5, 123/188.2, 188.3, 188.1, 188.4; 251/328, 251/329, 333; 29/888.4, 888.44
See application file for complete search history.

(56) References Cited

U.S. PATENT DOCUMENTS 1,418,911 A * 6/1922 Garlick ..... 123/188.7
2,988,080 A * 6/1961 Radomir ..... 123/188.2
4,309,969 A * 1/1982 Matthes ..... 123/188.7
4,790,272 A * 12/1988 Woolenweber ..... 123/188.4
4,981,118 A * 1/1991 Lefebvre ..... 123/188.3
5,005,538 A * 4/1991 Bergeron ..... 123/188.3
5,168,843 A * 12/1992 Franks ..... 123/188.3
5,301,640 A * 4/1994 Barranco, Jr. ..... 123/188.3
2005/0098137 A1* 5/2005 Tanaka et al. ..... 123/188.3

* cited by examiner

*Primary Examiner*—Erick Solis
(74) *Attorney, Agent, or Firm*—MotoCzysz LLC; Richard Calderwood

(57) ABSTRACT

A poppet valve for use in an internal combustion engine. The poppet has a partially-inverted perimeter shape which nevertheless substantially maintains the curtain area of the valve. These improved valves pack more efficiently into the combustion chamber roof area than would conventional, circular-perimeter poppet valves. For the same size combustion chamber, significantly greater total curtain area is achieved, improving engine performance. Valve weight is greatly reduced, enabling the use of lighter return springs, camshafts, desmodromic actuators, and so forth.

12 Claims, 14 Drawing Sheets

50

INVERTED POPPET VALVE FOR INTERNAL COMBUSTION ENGINE

BACKGROUND OF THE INVENTION

1. Technical Field of the Invention

This invention relates generally to internal combustion engines, and more specifically to poppet valves for such.

2. Background Art

Internal combustion engines use a variety of types of valves to control the intake and exhaust of gases as the engines operate. Most internal combustion engines are of the four-stroke variety, and most four-stroke engines use poppet valves. Such an engine includes a head which forms the upper surface of the combustion chamber. The intake and exhaust valves open and close to permit or restrict gas flow through their respective intake and exhaust openings in the head. It is generally recognized as highly desirable to provide an engine with large valves, to improve the engine's ability to "breathe". An engine is essentially a gas pump which pumps in air-fuel mixture and pumps out waste gas or exhaust. Because the exhaust gas is typically under significantly greater pressure than the air-fuel mixture, most engine designs use intake valves which are larger than their exhaust valves.

FIG. 1 illustrates a poppet valve 10 according to the prior art. The valve includes an elongated, cylindrical stem 12 coupled to (and typically integrally formed with) a poppet 14. The poppet is sometimes referred to as the disc of the valve. The poppet is typically adapted with a seating face 16 which is angled to mate with a corresponding surface in the head (not shown) known as the valve seat. The widest part 18 of the poppet limits the size of the valve and the lift, as the valve must not be permitted to strike or interfere with any other engine component.

Modern four-stroke engines use overhead camshafts to open their valves, and valve springs to return the valves to their closed position. In most instances, the valves and their actuating hardware such as shims, buckets, cam followers, and so forth, are designed to permit—and in many cases encourage—the valves to gradually rotate within their valve seats. This improves the evenness of valve wear, and helps prevent loss of compression due to localized carbon buildup and the like. Therefore, valves are constructed as an axisymmetric revolve, meaning that they are symmetrical about the axis of their shaft. This symmetry also improves manufacturability and lowers manufacturing cost.

FIG. 2 illustrates a head 20 according to the prior art. In the interest of clarity and ease of illustration, a variety of well-known features have been omitted from the head, such as water jackets, and the head has been shown as having a flat-roofed combustion chamber. Those of ordinary skill in the art will readily appreciate how these conventional features would exist.

The head includes a block surface 22 which mates to the lower engine components (not shown) such as the cylinder block. The head is indented with a combustion chamber roof 24. A squish band 26 forms an angled transition between the roof and the block surface. A spark plug hole 28 extends through the head and is typically located near the center of the roof so as to provide substantially equal distances that the flame must travel from the spark plug to the outer perimeter 30 of the roof. This outer perimeter defines the "size" of the combustion chamber and is the primary factor limiting the size of the valves.

Within the roof perimeter, the head includes one or more intake valve openings 32 and one or more exhaust valve openings 34. The intake valve openings connect to intake tracts 36, and the exhaust valve openings connect to exhaust ports 38. Each intake valve opening includes an intake valve seat 40, and each exhaust valve opening includes an exhaust valve seat 42.

The intake valve openings have a circumference CIN and the exhaust valve openings have a circumference CEX. The head must not have any interference between the circumferences of the valves, the spark plug hole, and the perimeter of the combustion chamber roof.

Finally, the head is provided with a valve stem guide hole 44 in the center of each valve position.

FIG. 3 illustrates the head as viewed from the camshaft or upper side. The spark plug hole 28 extends through the head, and a spark plug access opening 46 extends into the head to within a short distance (approximately the thread length of the spark plug). One or more sets of camshaft bearing supports 48 are positioned to hold the camshaft(s) (not shown).

FIG. 4 illustrates a head assembly 50 including the head 20, two conventional intake valves 52, and two conventional exhaust valves 54. For convenience, the valves are all shown in their fully opened position to illustrate the "intake curtain area" 56 and the "exhaust curtain area" 58 through which the gases must flow into and out of the combustion chamber.

FIG. 5 illustrates the head assembly 50 in cross-section view, showing the head 20, intake valves 52, and intake curtain areas 56.

DETAILED DESCRIPTION

The invention will be understood more fully from the detailed description given below and from the accompanying drawings of embodiments of the invention which, however, should not be taken to limit the invention to the specific embodiments described, but are for explanation and understanding only.

Figure 6:
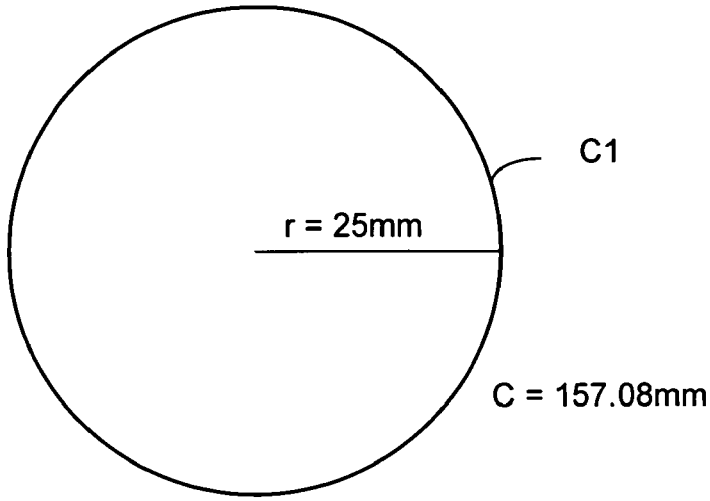
FIG. 6 shows the circumference of the conventional valve.

FIG. 6 illustrates the outer perimeter C1 of a 50 mm valve having, of course, a 25 mm radius poppet. The circumference C of the poppet is, to a first order, a good approximation of the circumference of the curtain area, and is equal to $2\pi r=157.08$ mm.

Figure 7:
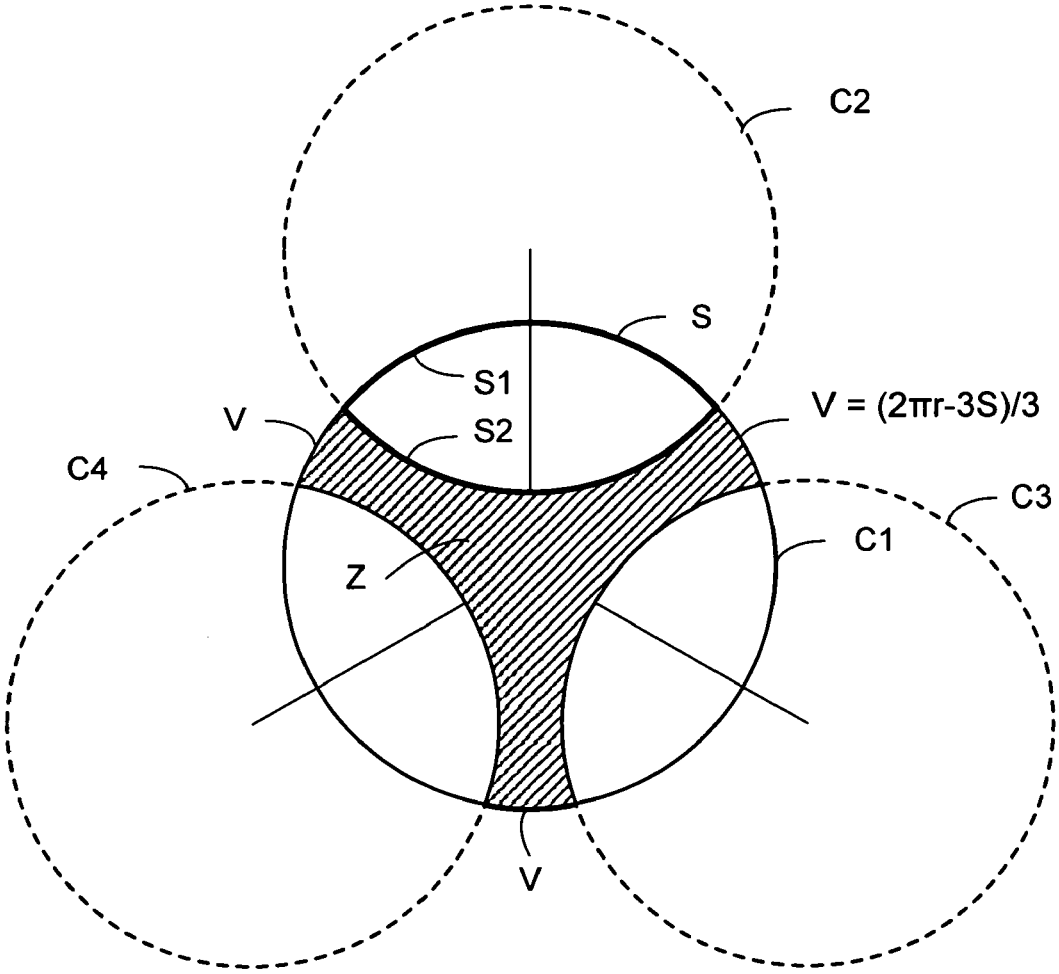
FIG. 7 shows a geometric relationship between certain figures including overlapping circles.

FIG. 7 illustrates a geometric relationship between overlapping circles. A center circle C1 is intersected by three other circles C2–C4, each having its center equidistant from the center of the center circle. The three circles are disposed at 120° intervals around the center circle. All four circles are of equal radius. Regardless of the relative lengths of the radius and the on-center distance, each pair of overlapping circles will define a pair of arcs S1 and S2 (shown in heavier lines) which are of equal arc length. The center circle has three non-overlapped arcs V, each having a length equal to $(2\pi r-3S)/3$.

The reader should take special notice of the fact that the shaded area Z has the same total circumference as does the center circle, $2\pi r$, although its area is significantly smaller than that of the center circle. The shaded shape is essentially a circle which has three inverted arcs at its perimeter.

If the three circles have a different radius than does the center circle, the perimeter of the shaded area Z will change, but it will change less than the area has changed between the center circle and the shaded area.

These relationships hold true with numbers of outer circles other than three. And they hold true, albeit to a lesser degree, with outer shapes that are not circular; meaning that arcs of the center circle's perimeter can be inverted (turned inward or concave), even if they are then changed into somewhat different shapes, and the perimeter will in most simple cases change significantly less than the area changes.

FIGS. 8–19 illustrate six embodiments of poppet valves according to various embodiments of this invention. Each consecutively-numbered (and vertically aligned) pair of drawings represent the same valve in perspective view and top view, respectively.

Figure 8:
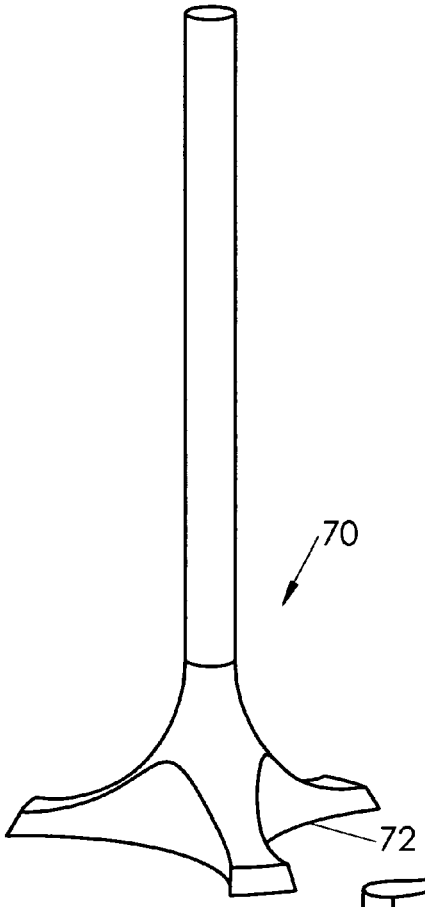
FIGS. 8–19 shows, in corresponding pairs of perspective view and top view, a variety of valves according to various embodiments of this invention.
Figure 9:
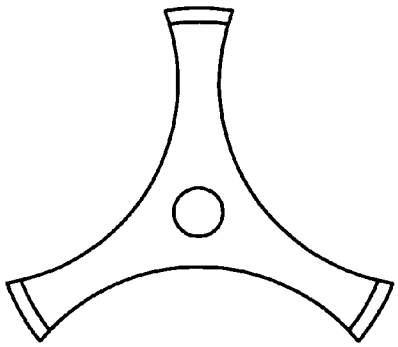

FIGS. 8–9 illustrate a valve 70 which has had its outer perimeter 72 simplistically "folded in" as shown in FIG. 7.

Figure 10:
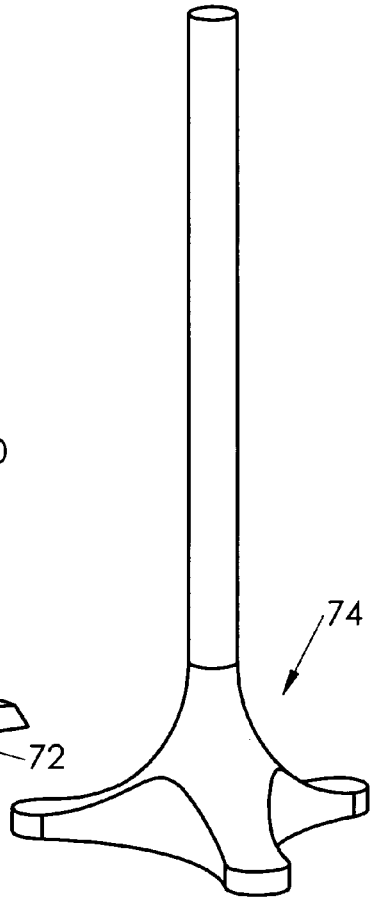
Figure 11:
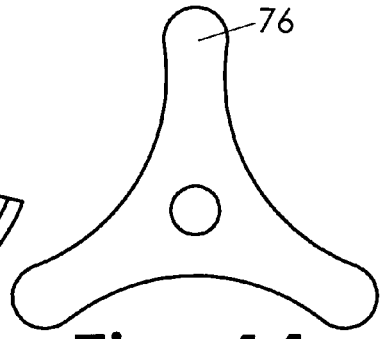

FIGS. 10–11 illustrate a similar valve 74 which has been modified with rounded "ends" 76. Thus, the perimeter will not exactly match that of the corresponding circle.

Figure 12:
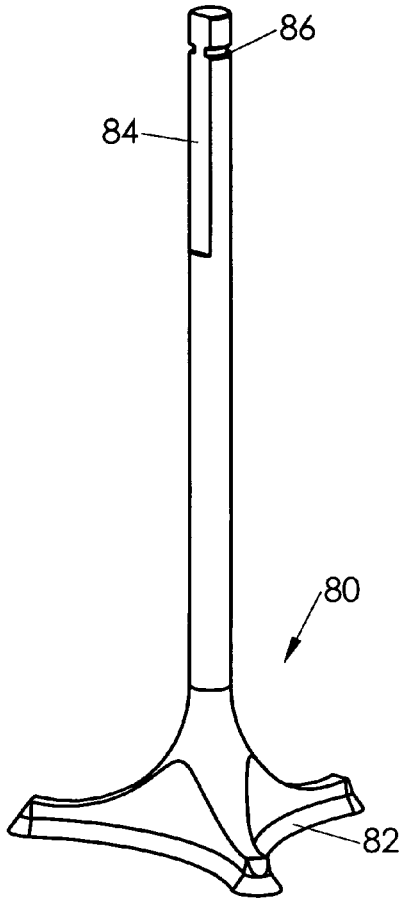
Figure 13:
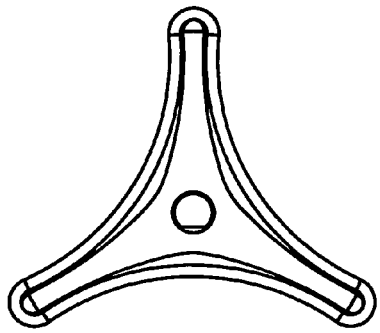

FIGS. 12–13 illustrate a valve 80 which has had a slightly more sophisticated shape applied to it, including the forming of a valve seat mating face 82. Further, the valve stem has been adapted with a flat 84 for clocking the valve into a fixed rotational position to correctly align it with the head's valve seat. And a retention groove 86 has been added, to facilitate e.g. desmodromic valve actuation.

Figure 14:
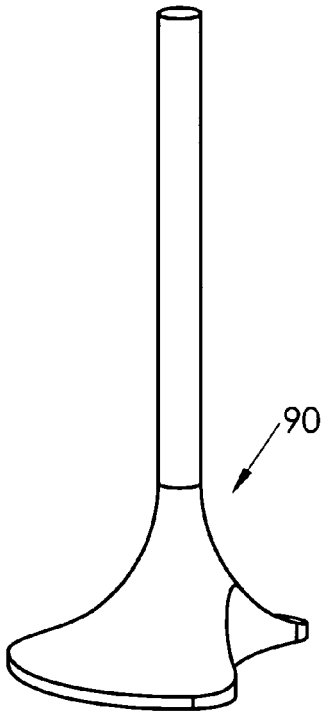
Figure 15:
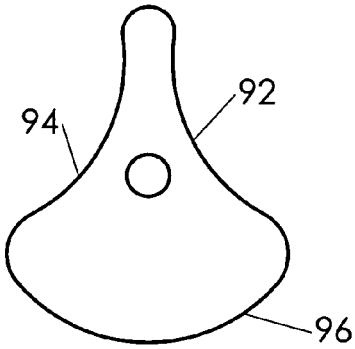

FIGS. 14–15 illustrate a valve 90 which includes two inverted arc perimeter segments 92, 94 as well as a portion 96 which retains the original perimeter shape. The valve is, thus, not necessarily strictly symmetric. Because it is not inherently balanced, the designer will need to take appropriate measures to strengthen it adequately.

Figure 16:
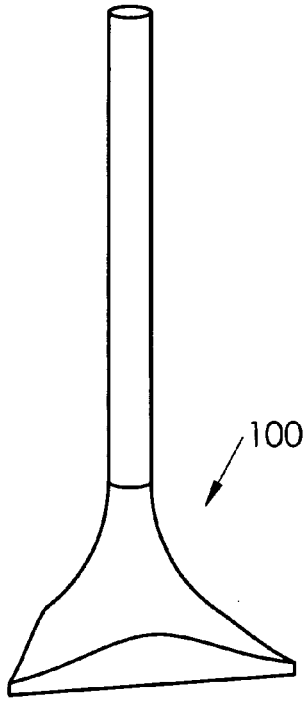
Figure 17:
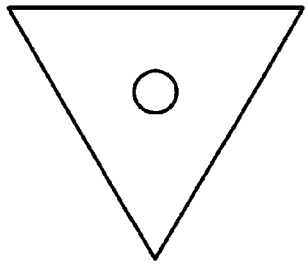

FIGS. 16–17 illustrate a valve 100 with a triangular shape with substantially straight edges. The valve is not necessarily based on a starting shape with a circular perimeter.

Figure 18:
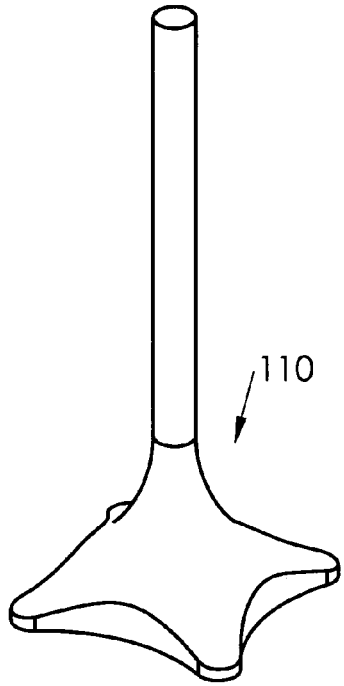
Figure 19:
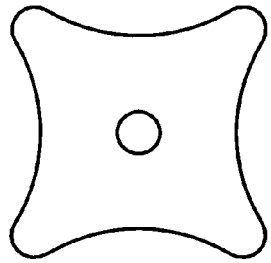

FIGS. 18–19 illustrate a valve 110 with a square perimeter shape which has been modified with inwardly folded circular arc segments.

The valves of FIGS. 8–19, and others based upon the principles of this invention, may all be referred to as "inverted poppet valves".

Figure 20:
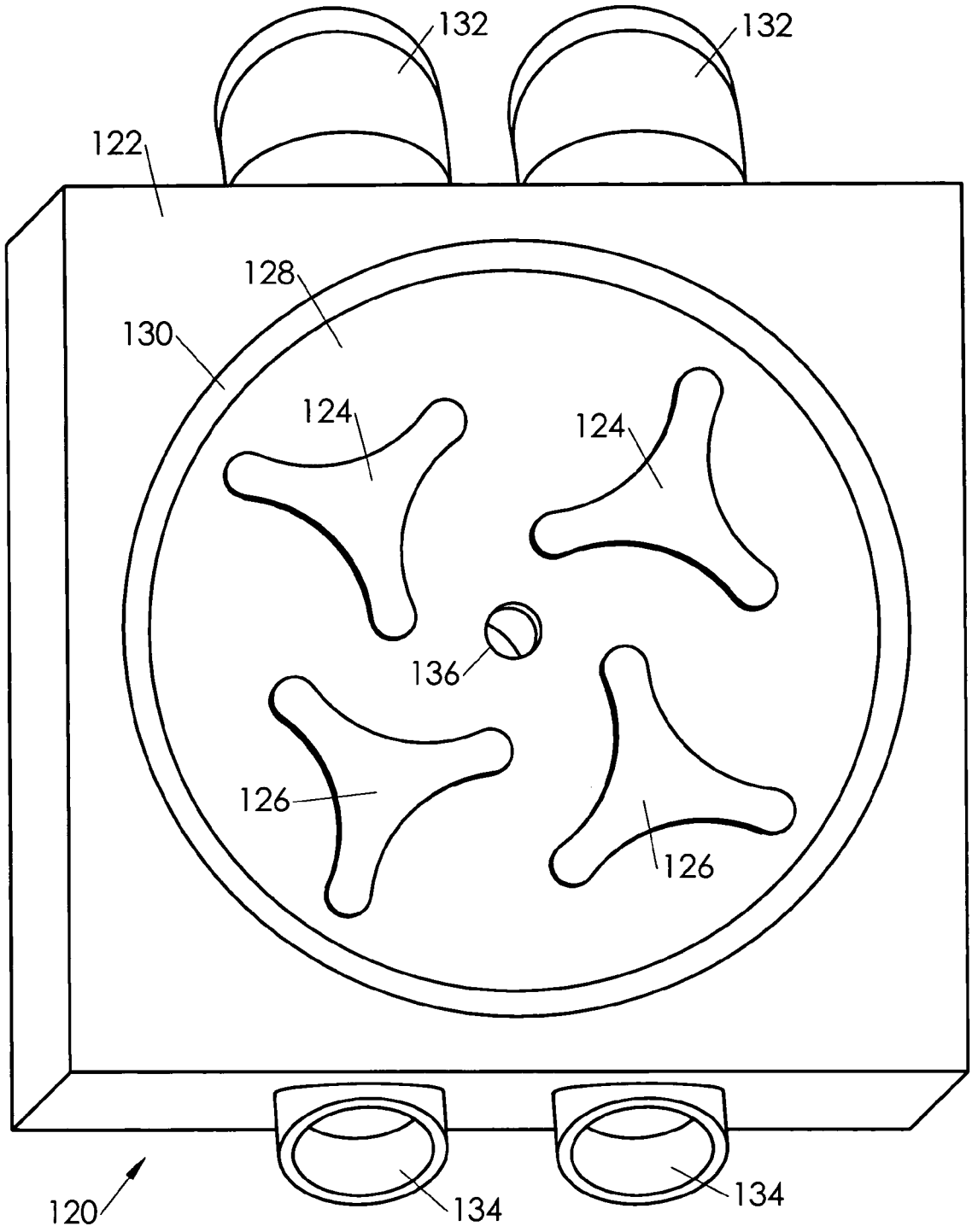
FIG. 20 shows a head assembly, with two intake valves and two exhaust valves as shown in FIG. 8.

FIG. 20 illustrates a head assembly 120 including a head 122 adapted for use with one or more inverted poppet intake valves 124 and one or more inverted poppet exhaust valves 126. The head includes a roof 128, squish band 130, intake tracts 132, exhaust ports 134, and spark plug hole 136. The intake valves may share a common intake tract, or, as shown, each intake valve may be provided with its own, dedicated intake tract. The same is true of the exhaust valves.

Figure 21:
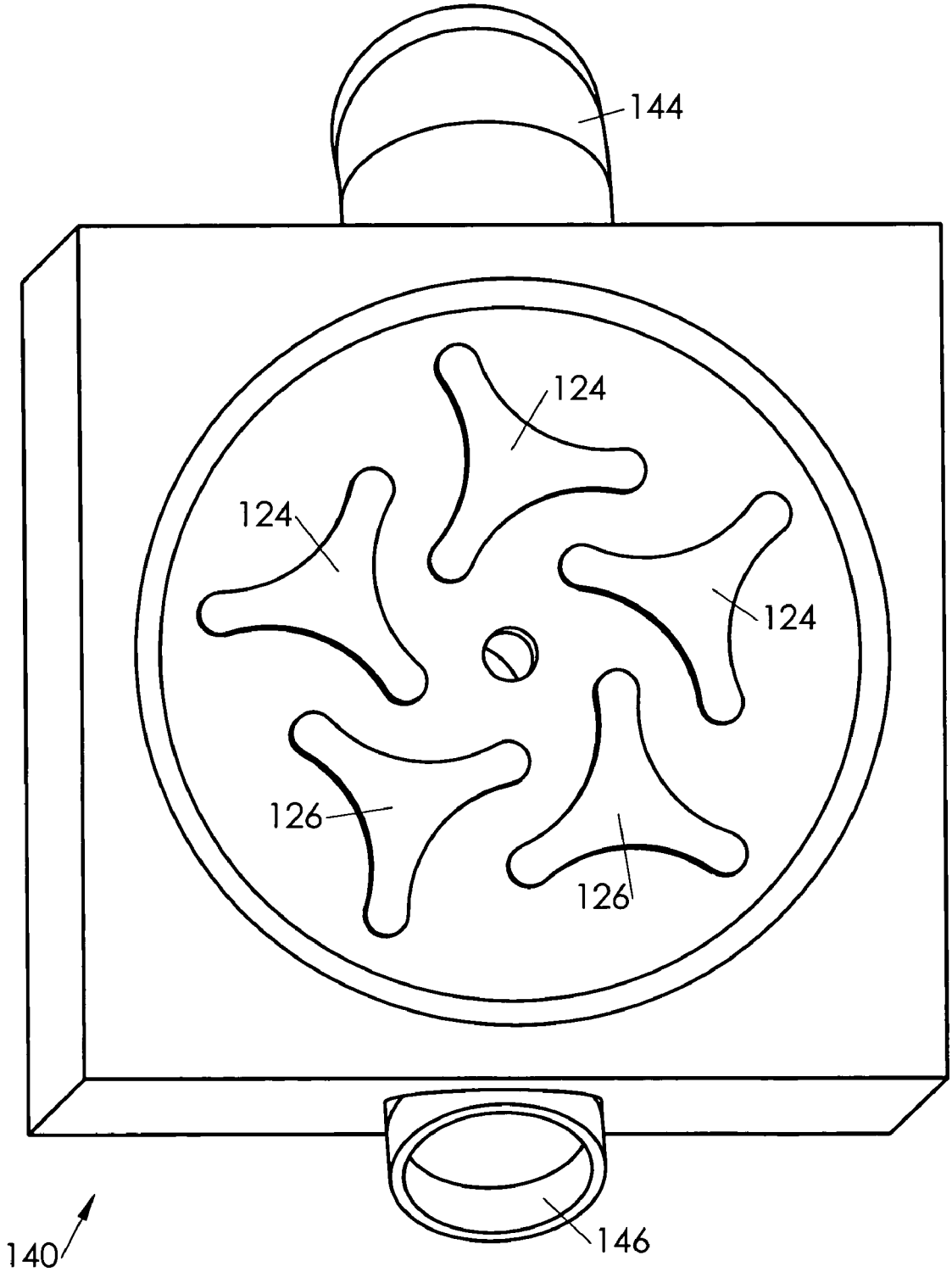
FIG. 21 shows another head assembly, with three intake valves and two exhaust valves as shown in FIG. 8.

FIG. 21 illustrates a head assembly 140 having three inverted poppet intake valves 124 and two inverted poppet exhaust valves 126. The head 142 include a common intake tract 144 for all three intake valves, and a common exhaust port 146 for both exhaust valves.

Figure 22:
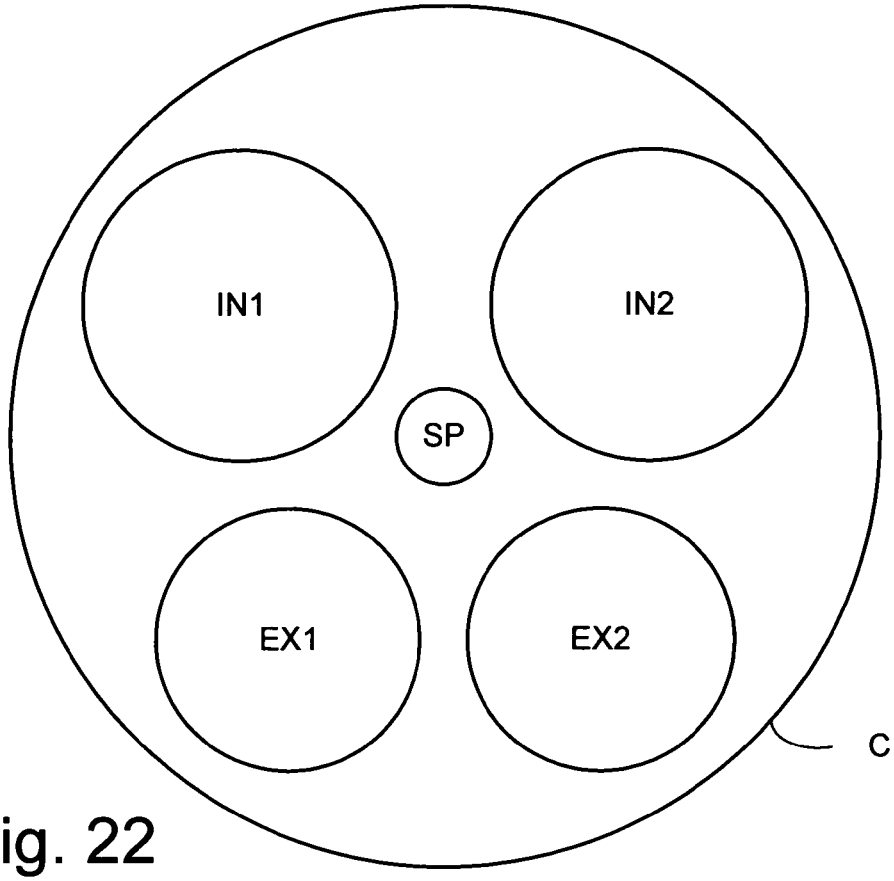
FIG. 22 shows a geometric relationship between the circumferences of the two intake valves, two smaller exhaust valves, and combustion chamber area of a conventional (and greatly simplified) head, making maximum usage of the combustion chamber with the largest valves possible.

FIG. 22 illustrates a geometric relationship between the valve perimeters, spark plug hole perimeter, and combustion roof perimeter of a conventional four-valve head. The roof has a perimeter C, within which must fit—without interference or overlap—the perimeters IN1 and IN2 of two intake valves, the perimeters EX1 and EX2 of two exhaust valves, and the perimeter SP of the spark plug hole. To increase engine performance, the intake valves may be made larger, by reducing the size of the exhaust valves.

Figure 23:
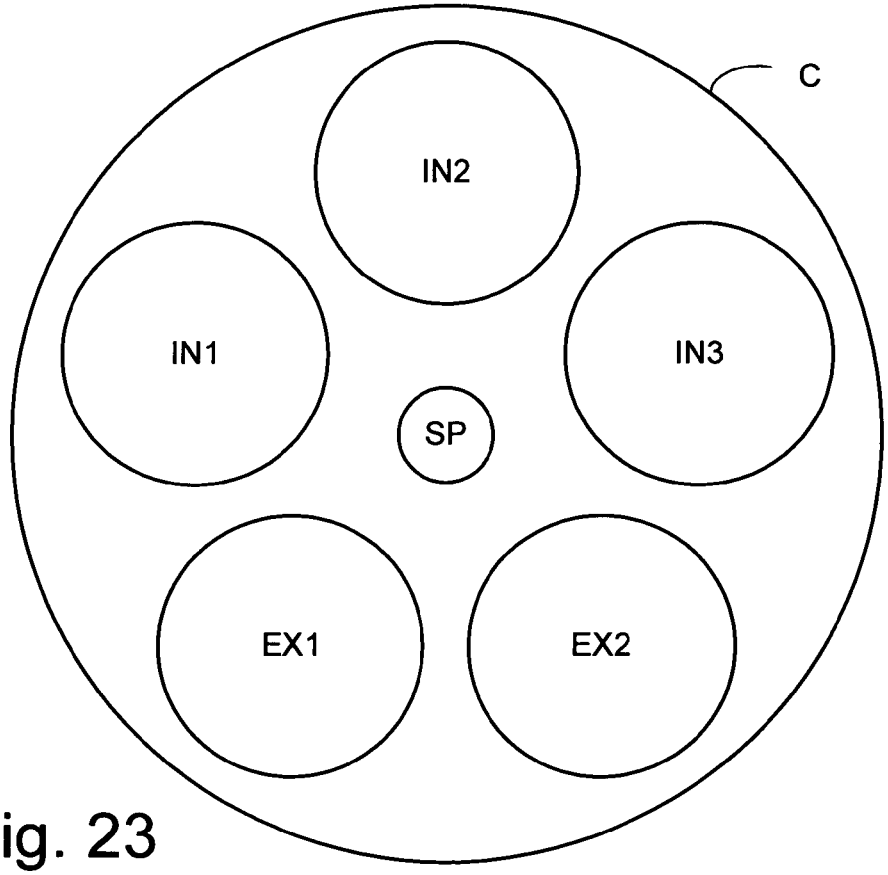
FIG. 23 shows a geometric relationship between the circumferences of the three intake valves, two same-sized exhaust valves, and combustion chamber area of another conventional head, making maximum usage of the combustion chamber with the largest valves possible.

FIG. 23 illustrates a geometric relationship between the valve perimeters, spark plug hole perimeter, and combustion roof perimeter of a conventional five-valve head. The roof has the same perimeter C, within which must fit the perimeters IN1, IN2, and IN3 of the three intake valves, the perimeters EX1 and EX2 of the two exhaust valves, and the perimeter SP of the spark plug hole. As can be seen by comparison to FIG. 22, the five-valve head offers somewhat improved overall valve area.

Figure 24:
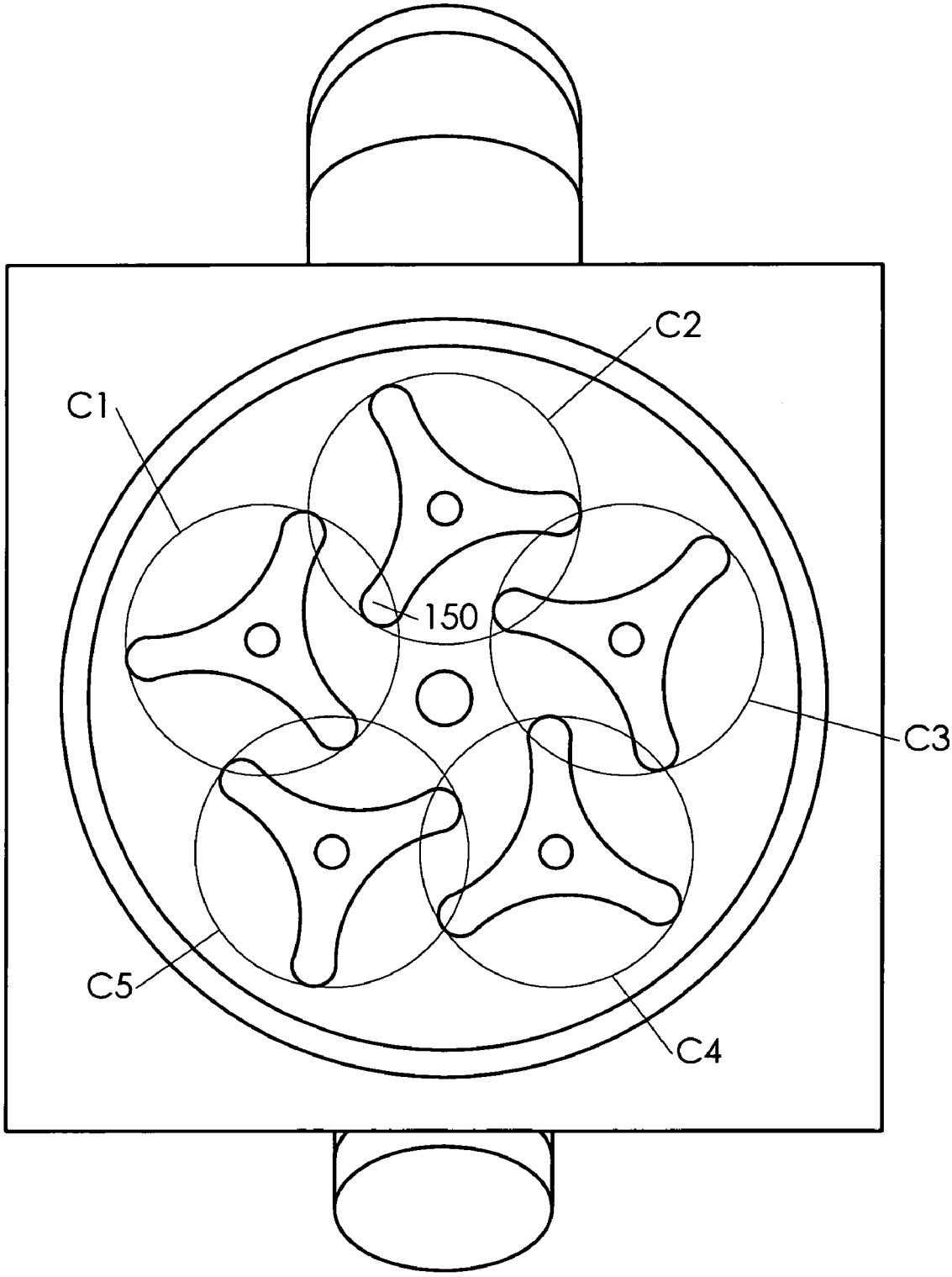
FIG. 24 shows a geometric relationship obtained from a five-valve head according to one embodiment of this invention.

FIG. 24 illustrates a geometric relationship between the valve perimeters, spark plug hole perimeter, and combustion roof perimeter of a five-valve head according to one embodiment of this invention, with the geometry overlayed on the head of FIG. 21. As can readily be seen, if the valves were "un-inverted", or converted back to their correspondingly-sized conventional circular perimeter counterpart valves, the perimeters C1–C5 would significantly overlap. This pointedly illustrates the advantage gained from this invention—valve curtain area significantly larger than could be fit within the same-sized combustion chamber using conventional circular poppet valves. Note that each valve includes a portion 150 which intrudes into the perimeter circle of a neighboring valve. However, because that neighboring valve uses an inverted poppet, there is no interference, as the two valves are clocked into a beneficial angular relationship.

In addition to the significant advantage of increased curtain area, the inverted perimeter valve of the present invention also offers the further advantage of significantly lower valve mass. The poppet contains much less metal. This, in turn, allows the use of a thinner valve stem, further reducing the mass. The reduced valve mass permits improvements in the mass and/or effectiveness of the valve return spring, camshaft, desmodromic actuators, and so forth.

Figure 1:
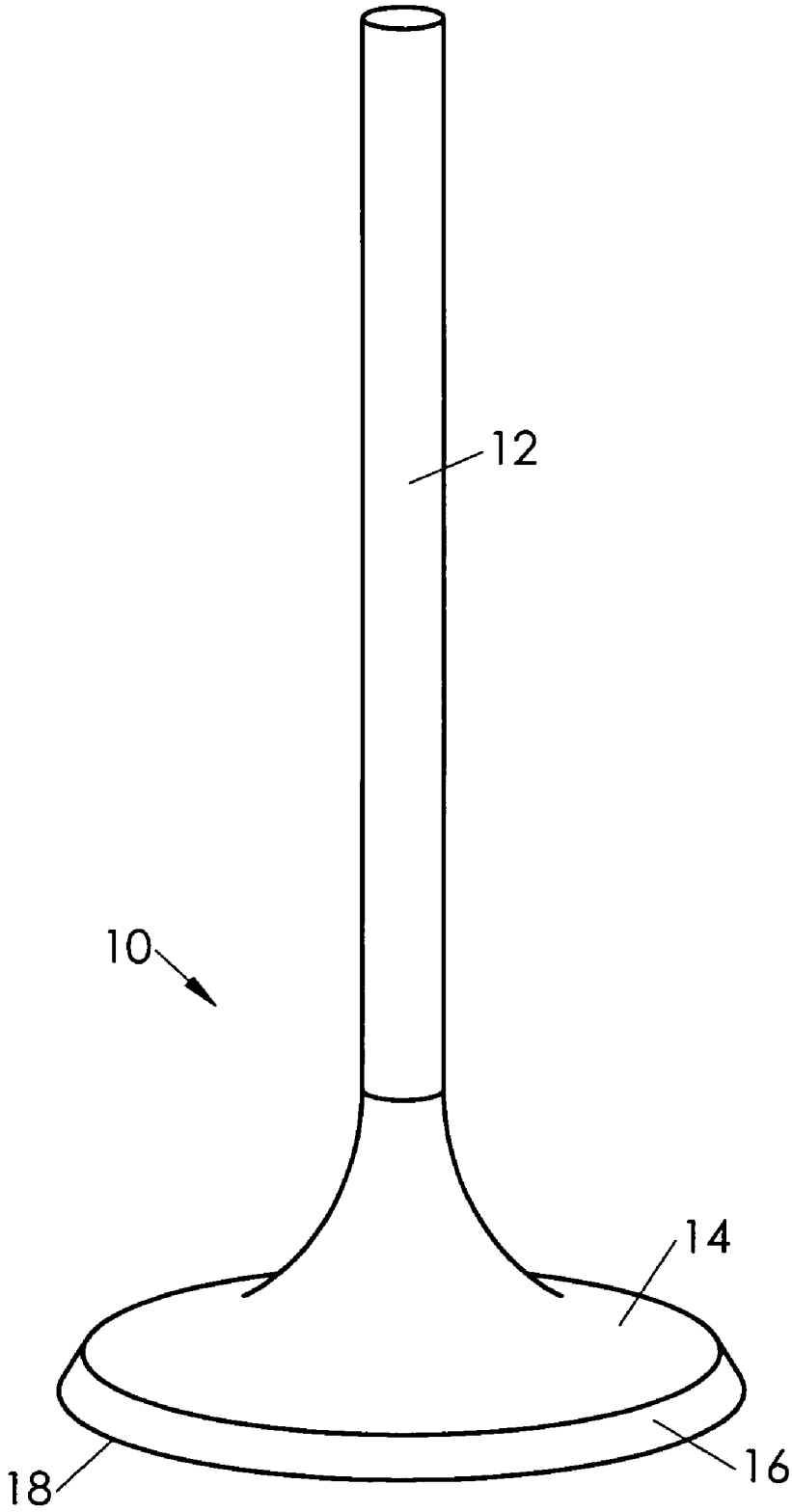
Fig. 1 prior art
FIG. 1 shows a conventional poppet valve.
Figure 2:
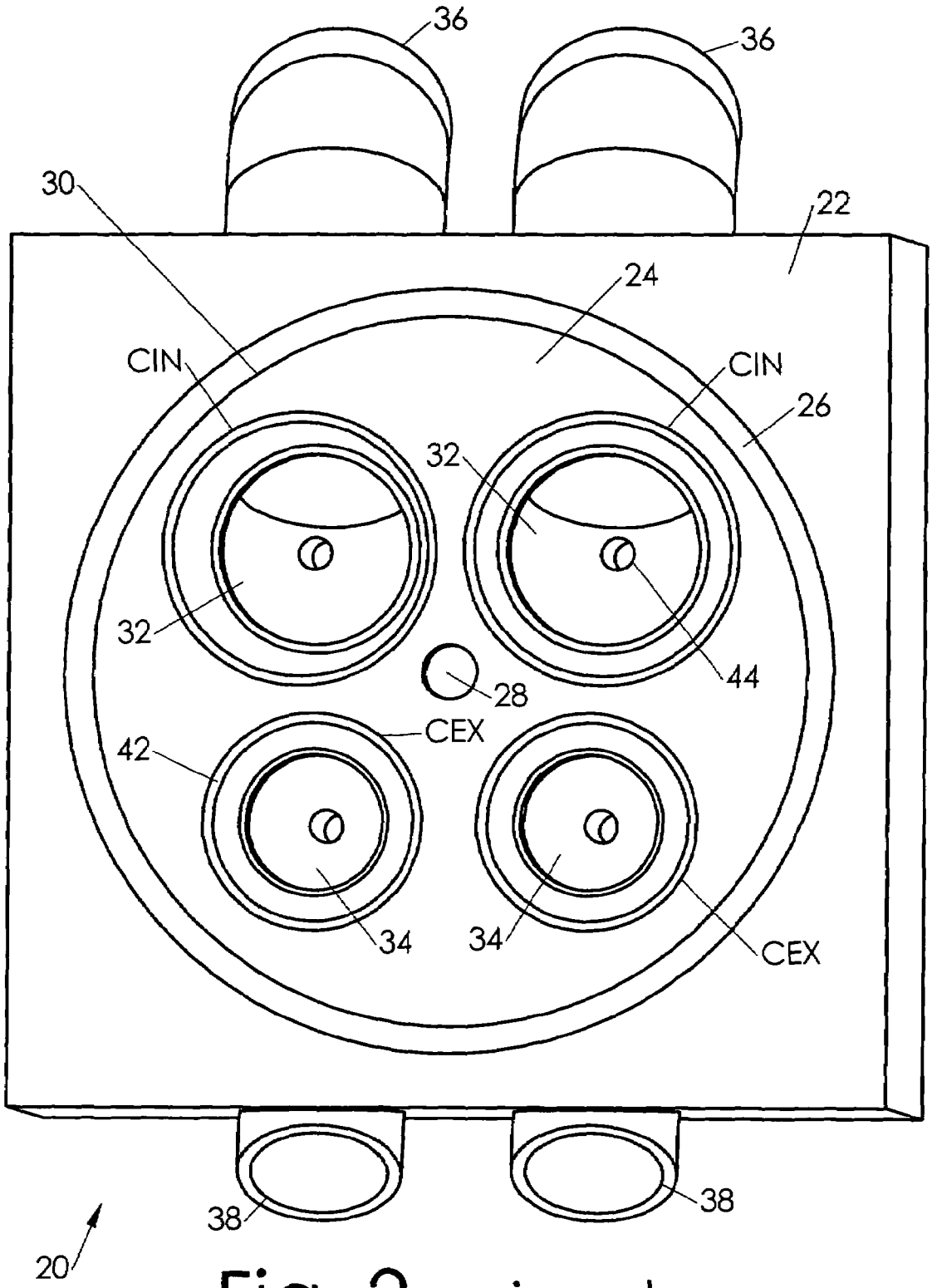
Fig. 2 prior art
FIG. 2 shows a conventional head for use in a four-stroke internal combustion engine, as seen from the combustion chamber or bottom side.
Figure 3:
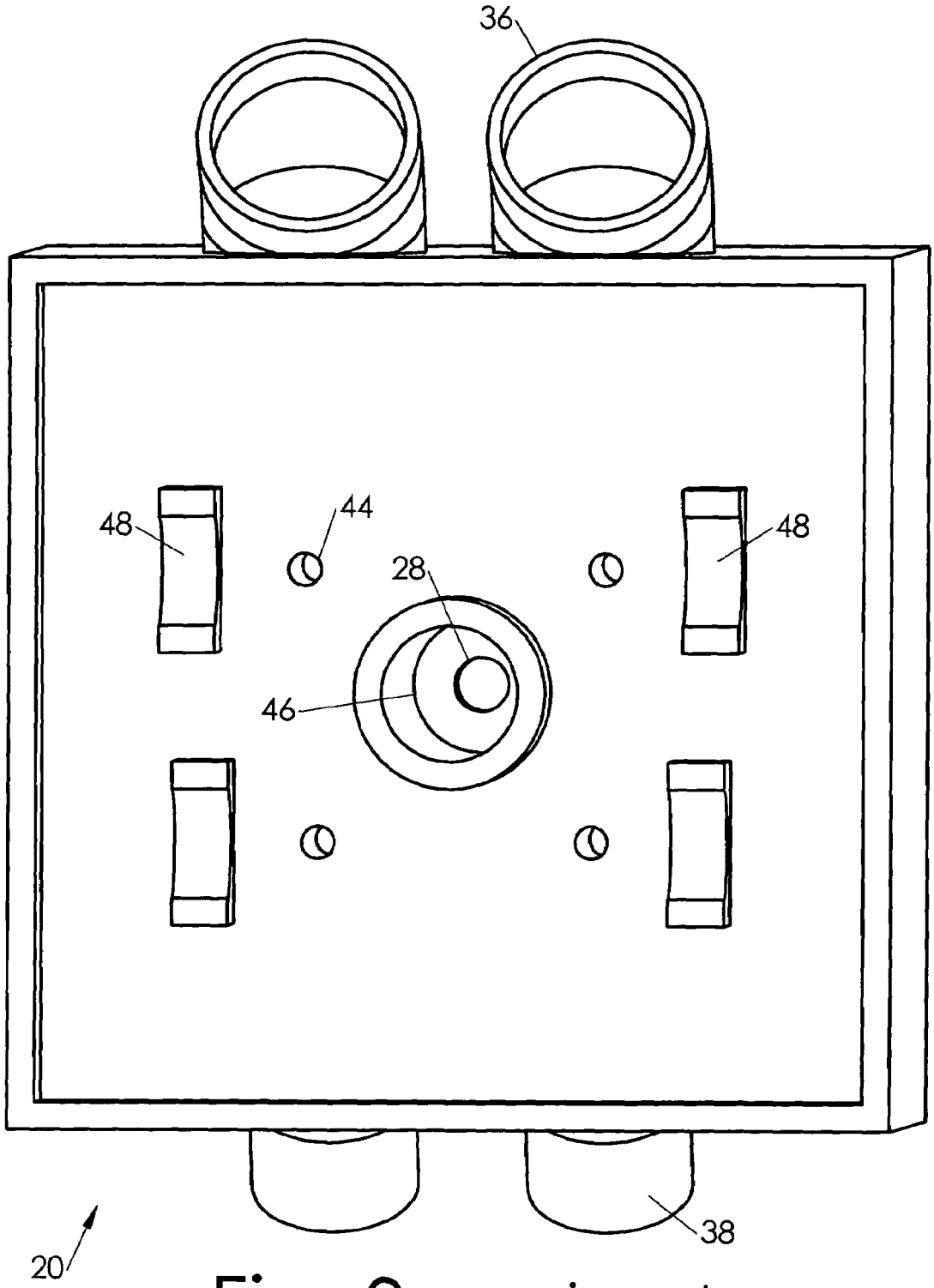
Fig. 3 prior art
FIG. 3 shows the head of FIG. 2, as seen from the camshaft or top side.
Figure 4:
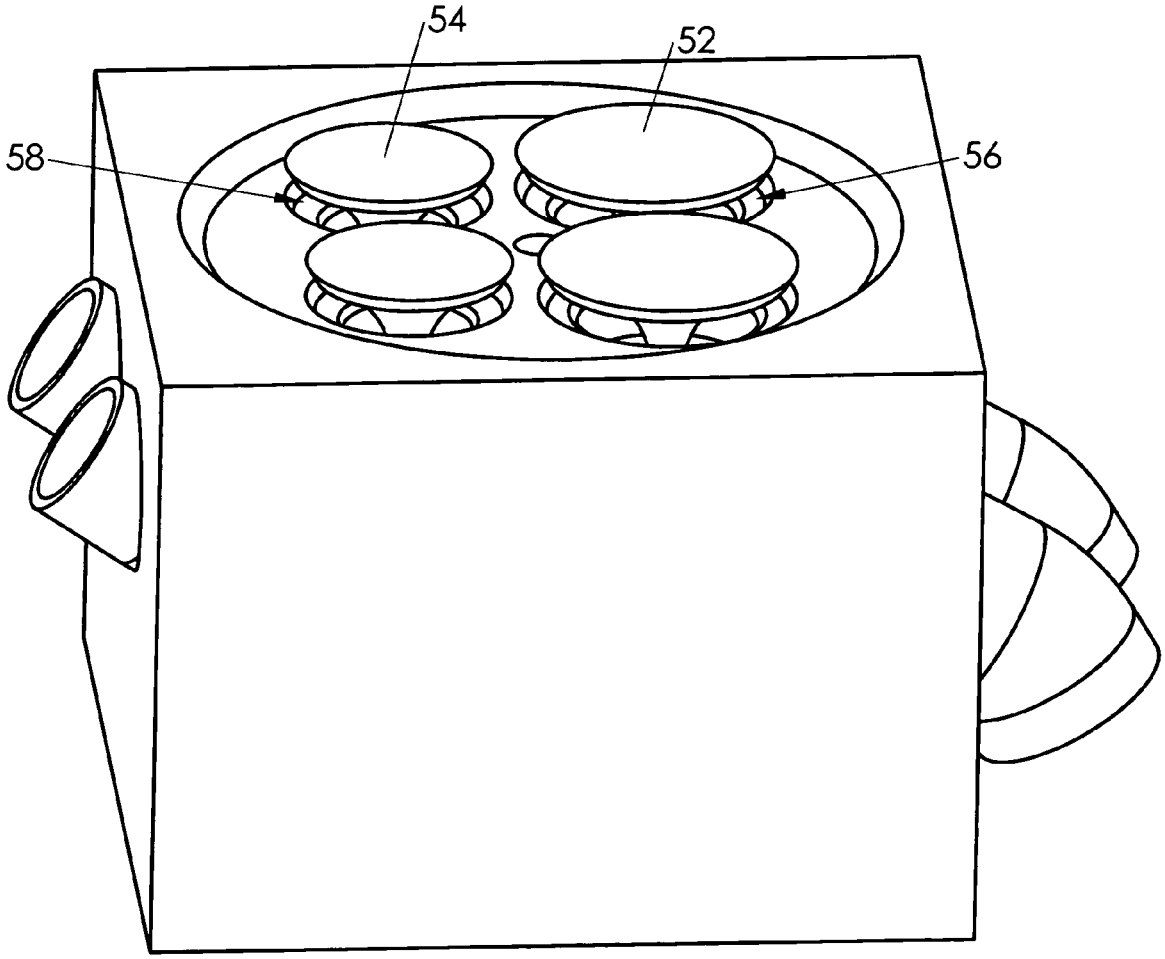
Fig. 4 prior art
FIG. 4 shows the head of FIGS. 2 and 3 adapted with two conventional intake valves and two conventional exhaust valves such as shown in FIG. 1.
Figure 5:
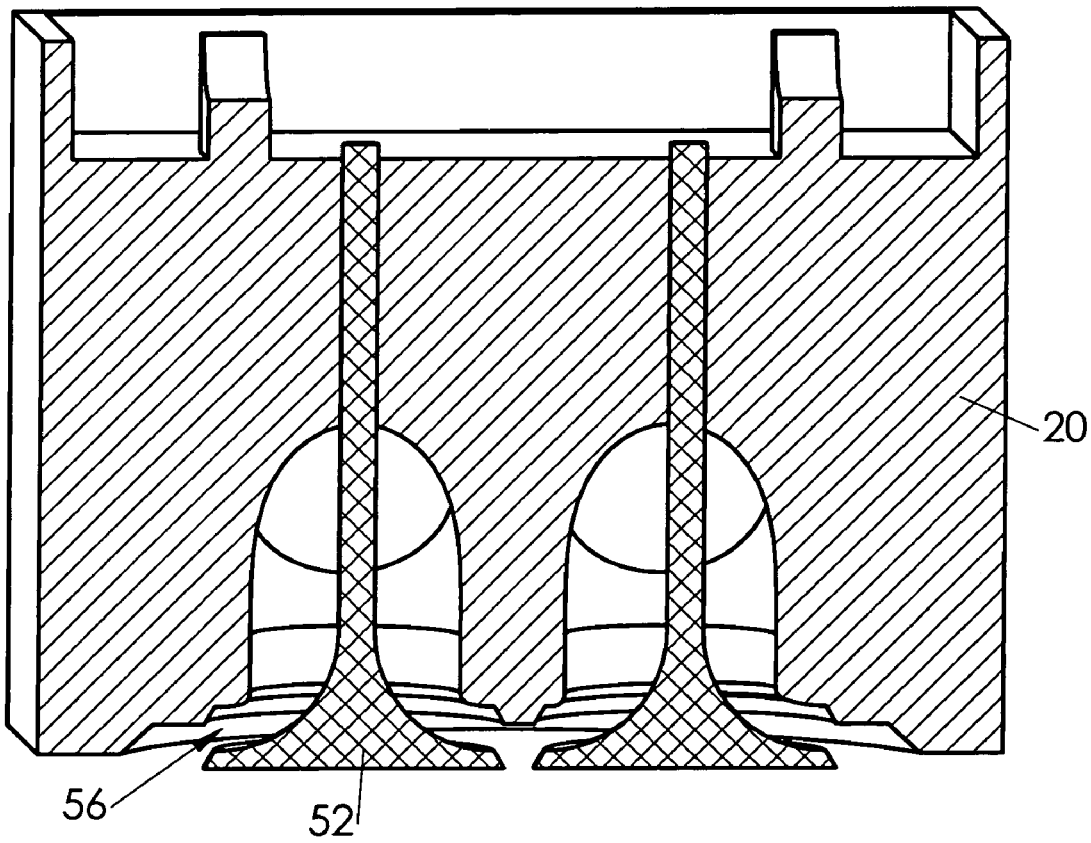
Fig. 5 prior art
FIG. 5 shows the head assembly of FIG. 4 in cutaway view, particularly illustrating the valve curtains.

With the same diameter and length stem, the same diameter poppet, and so forth, the valve of FIG. 1 has a mass of 55.95 grams, and the valve of FIG. 8 has a mass of 29.42 grams, for a savings of 26.53 grams or 47.4%. Similarly configured, the valve of FIG. 12 has a mass of only 24.65 grams; if its stem diameter is reduced from 6 mm to 5 mm, it has a mass of only 20.95 grams, a 62.6% reduction from the original.

Furthermore, the "inverted" valve has a significantly higher ratio of (1) surface area in contact with the head, to (2) mass, than does a conventional valve of the same "perimeter dimension" or of the same curtain area. This means that the inverted valve will exhibit significantly better heat transfer (from the valve to the head) than a conventional valve exhibits. The inverted valve will not be as susceptible to overheating as the conventional valve.

Figure 25:
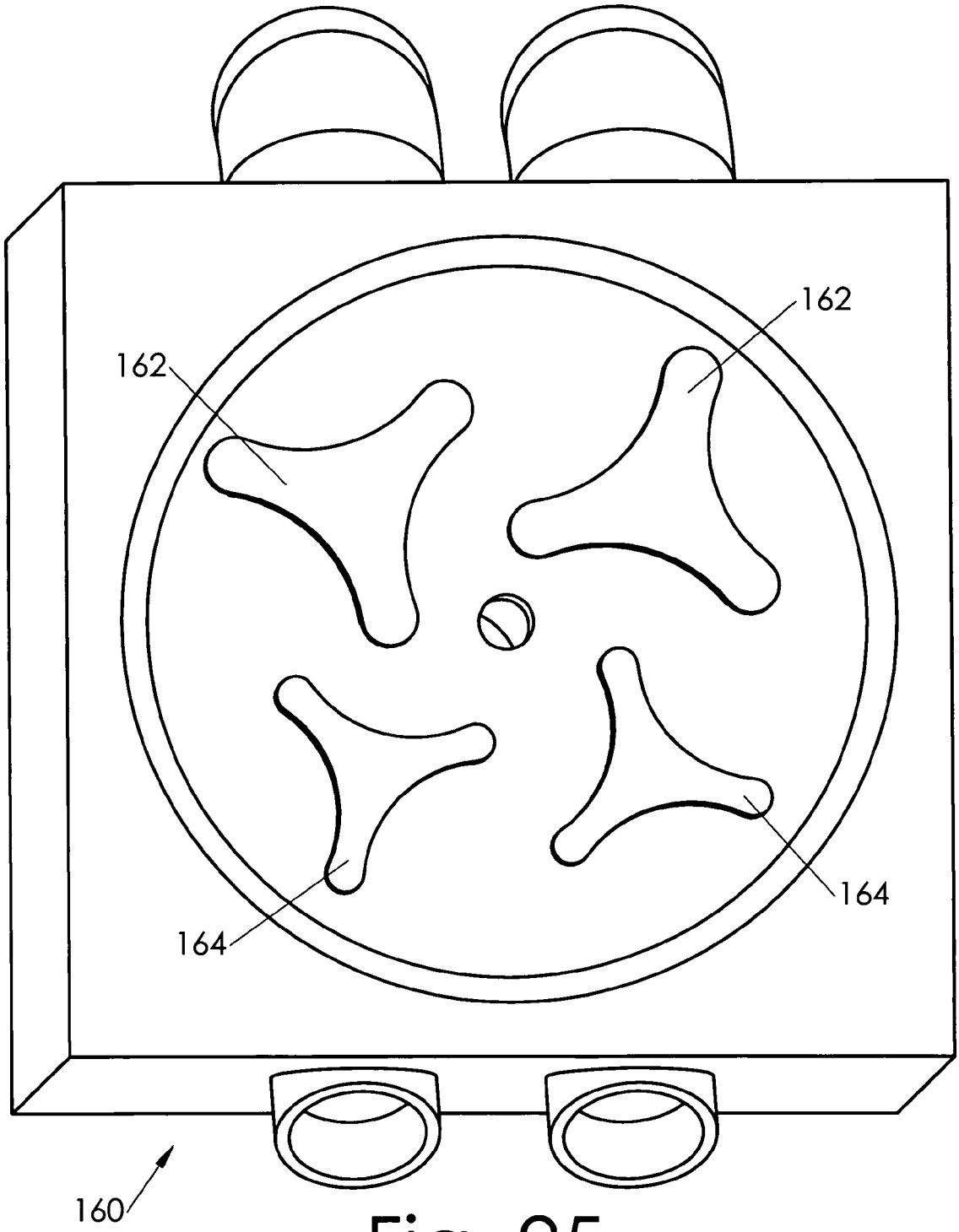
FIG. 25 shows another head assembly, using different size valves.

FIG. 25 illustrates a head assembly 160 according to another embodiment of this invention, using two or more different sizes of valves. In the embodiment shown, the intake valves 162 are larger than the exhaust valves 164.

Figure 26:
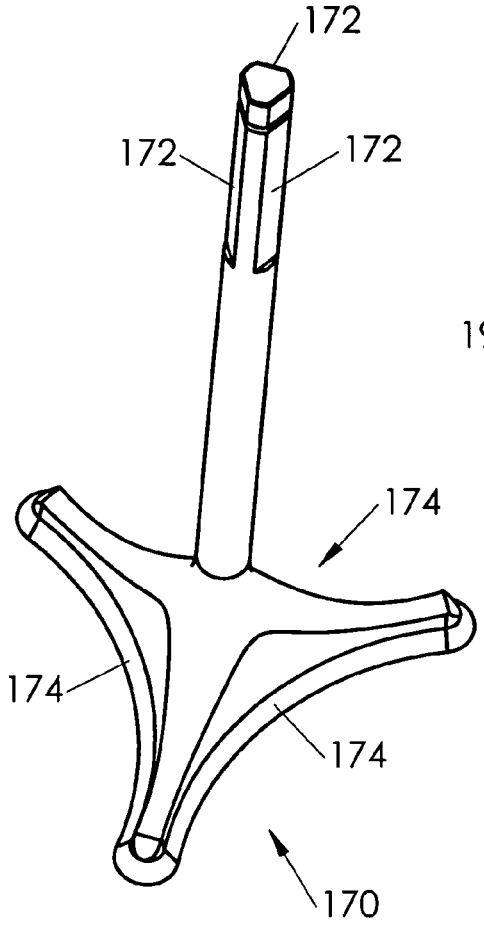
FIG. 26 shows another embodiment of a valve using multiple stem flats for alignment.

FIG. 26 illustrates an inverted poppet valve 170 in which the stem is adapted with the same number of flats 172 as the poppet has inverted segments 174. If the inverted segments of the poppet are the same dimensions and are symmetrically arranged around the poppet, and the flats are the same dimensions and are symmetrically arranged around the stem, the angular orientation of the valve in the head (not shown) will not be as critical as if there is only a single flat. In other words, if there are three flats, there are three possible orientations into which the valve can be placed in the head. This will ease the assembly of the engine, and may further offer an opportunity for the mechanic to rotate the valves (e.g. by 120°) when rebuilding the engine, such that each inverted segment of the valve can then be put into contact with a newly corresponding segment of the head's valve seat, potentially extending the serviceable life of the valve.

Figure 27:
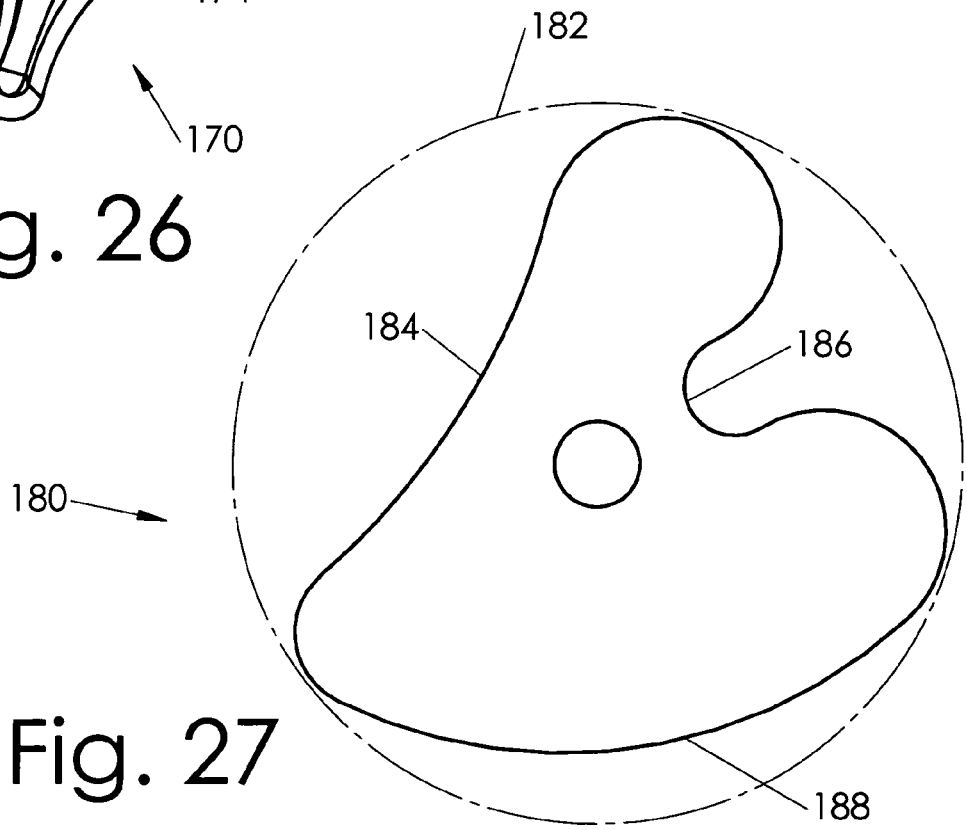
FIG. 27 shows a highly asymmetrical valve having three different sub-circular segments.

FIG. 27 illustrates a valve 180 in top view, and is primarily intended simply to illustrate the meaning of the term "sub-circular", which refers to a poppet perimeter segment which does not extend as far radially outward as if the poppet were a conventional, circular poppet. For example, a concave segment is sub-circular, a flat segment is sub-circular, and a segment having a different radius of curvature may be sub-circular. The valve is shown with reference to a perimeter bounding circle 182 having a given radius (say "R"). A first sub-circular segment 184 has a slightly concave shape whose radius is larger than R. A second sub-circular segment 186 has a highly concave shape whose radius is significantly smaller than R. A third sub-circular segment 188 has a convex shape whose radius is larger than R. These and a variety of other sub-circular segment shapes will allow a head to place larger valves closer together (meaning with overlapping bounding circles) than would be possible using conventional circular poppet valves.

Figure 28:
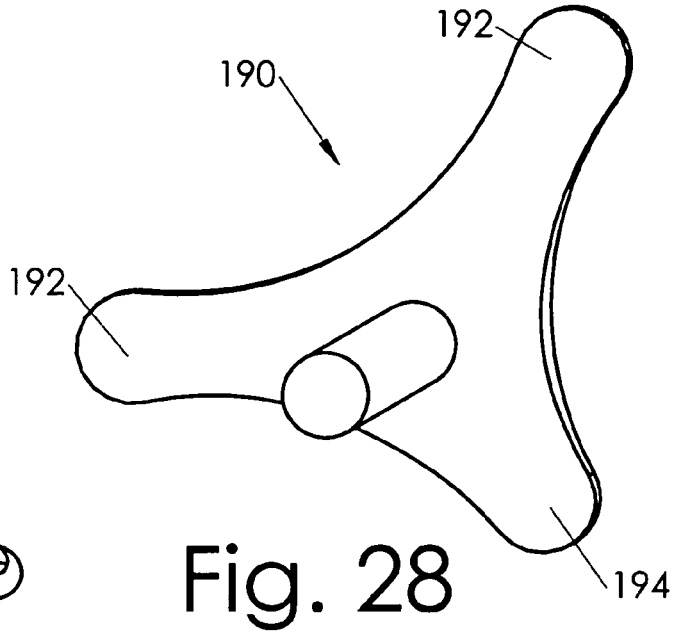
FIG. 28 shows a valve having a truncated finger between inverted arc segments.

FIG. 28 illustrates a valve 190 in which the portions between the inverted segments are of different lengths. Two such portions 192 extend to the bounding circle (not shown) of the valve, but a third such portion 194 is truncated short of the bounding circle. This enables the valve to be placed in the head (not shown) in positions and rotational orientations different than with other valves. For example, the truncated "finger" 194 can be oriented toward e.g. the squish band perimeter, or the spark plug hole, or another valve, with the valve being centered closer to that component than would be possible if one of the full-length fingers 192 were pointed in that direction. Shortening a finger gives up some curtain area versus keeping it full length, but this may actually permit e.g. larger valves or a greater number of valves to be used, for a net increase in curtain area. Another way of looking at this is that the other fingers 194 are made longer than they would otherwise be.

CONCLUSION

When components are said to be "coupled" to one another, this is not intended to preclude their being of unitary or monolithic construction, nor to suggest that there are no intervening structures or components between them.

The various features illustrated in the figures may be combined in many ways, and should not be interpreted as though limited to the specific embodiments in which they were explained and shown.

Those skilled in the art having the benefit of this disclosure will appreciate that many other variations from the foregoing description and drawings may be made within the scope of the present invention, and that various details of the engine (e.g. camshafts, valve guides, spark plugs, and the like) have been omitted for ease of illustration but are nevertheless well within the ability and familiarity of those skilled in engines. Indeed, the invention is not limited to the details described above. Rather, it is the following claims including any amendments thereto that define the scope of the invention.

What is claimed is:

1. A poppet valve comprising:

a stem; and a poppet coupled to the stem, wherein the poppet includes a perimeter which comprises a plurality of concave sub-circular segments, the perimeter further comprising a circle having a plurality of inverted arc segments;

wherein the poppet further includes fingers between the inverted arc segments.

2. The poppet valve of claim 1 wherein:

the perimeter of the poppet further comprises rounded transitions between inverted and non-inverted arc segments.

3. The poppet valve of claim 1 wherein:

at least one of the fingers is shorter than other fingers.

4. The poppet valve of claim 1 wherein:

the poppet further includes a seating face.

5. The poppet valve of claim 1 further comprising:

means for clocking the poppet valve into a predetermined rotational position.

6. The poppet valve of claim 5 wherein the means for clocking comprises:

at least one flat on the stem.

7. The poppet valve of claim 6 wherein the means for clocking further comprises:

as many flats as the poppet has inverted arc segments.

8. An improvement in a poppet valve, the poppet valve having a stem and a poppet, wherein the improvement comprises:

an outer perimeter of the poppet having a shape being that which results from inverting a plurality of arc segments of a circle, the outer perimeter of the poppet creating substantially a same curtain area as a curtain area of a bounding circle which minimally encloses the outer perimeter of the poppet.

9. The improvement of claim 8 in the poppet valve, wherein the improvement further comprises:

the shape being that which results from inverting three substantially equally spaced arc segments of a circle.

10. The improvement of claim 8 in the poppet valve, wherein the improvement further comprises:

the shape being that which results from inverting three substantially equally spaced arc segments of a circle which minimally bounds the poppet.

11. The improvement of claim 8 in the poppet valve, wherein the improvement further comprises:

the shape being that which results from inverting three substantially equally spaced arc segments of a circle which minimally bounds the poppet, and rounding transitions between inverted and non-inverted arc segments of the circle which minimally bounds the poppet.

12. An improvement in a head for use in an internal combustion engine, the head having a combustion chamber roof surface, at least one intake tract, and at least one exhaust port, wherein the improvement comprises:

a plurality of non-circular poppet valve openings extending through the roof surface and extending into neighboring non-circular poppet valve openings' bounding circles;

whereby the head includes increased perimeter sized valve openings; and a total curtain area of the poppet valve openings exceeding that which would be possible with a same number of circular poppet valve openings, wherein the non-circular poppet valve openings each has a shape resulting from inverting at least three arc segments of a circle.

* * * * *